US011145998B2

(12) United States Patent
Baumeister et al.

(10) Patent No.: US 11,145,998 B2
(45) Date of Patent: Oct. 12, 2021

(54) TERMINAL CLAMP WITHOUT HOUSING

(71) Applicant: BJB GmbH & Co. KG, Arnsberg (DE)

(72) Inventors: Olaf Baumeister, Sundern (DE); Philipp Henrici, Arnsberg (DE)

(73) Assignee: BJB GmbH & Co. KG, Arnsberg (DE)

( * ) Notice: Subject to any disclaimer, the term of this patent is extended or adjusted under 35 U.S.C. 154(b) by 0 days.

(21) Appl. No.: 16/985,291

(22) Filed: Aug. 5, 2020

(65) Prior Publication Data

US 2021/0098902 A1 Apr. 1, 2021

(30) Foreign Application Priority Data

Sep. 26, 2019 (DE) ..... 102019125886.3

(51) Int. Cl.

| | |
|---|---|
| ***H01R 3/00*** | (2006.01) |
| ***H01R 4/48*** | (2006.01) |
| ***H01R 12/57*** | (2011.01) |
| ***H01R 13/11*** | (2006.01) |
| ***H01R 43/22*** | (2006.01) |

(52) U.S. Cl.
CPC ..... *H01R 4/4827* (2013.01); *H01R 12/57* (2013.01); *H01R 13/11* (2013.01); *H01R 43/22* (2013.01)

(58) Field of Classification Search
CPC ..... H01R 13/465; H01R 13/62933; H01R 13/4362; H01R 2201/20
USPC ..... 439/488, 310, 752, 912
See application file for complete search history.

(56) References Cited

U.S. PATENT DOCUMENTS

| | | | | |
|---|---|---|---|---|
| 5,561,372 | A * | 10/1996 | Watanabe | G01R 31/69 324/538 |
| 6,123,574 | A * | 9/2000 | Matsuda | H01R 13/4223 439/488 |
| 6,332,803 | B1 * | 12/2001 | Matsuda | H01R 13/4223 439/488 |
| 6,669,507 | B2 * | 12/2003 | Yamanashi | H01R 13/4223 439/595 |
| 2015/0047183 | A1 | 2/2015 | Boyd, Jr. et al. | |

FOREIGN PATENT DOCUMENTS

| | | | |
|---|---|---|---|
| DE | 202014104939 | U1 | 2/2016 |
| DE | 202015103005 | U1 | 10/2016 |
| DE | 102015115791 | A1 | 3/2017 |
| DE | 102015122400 | A1 | 6/2017 |

* cited by examiner

*Primary Examiner* — Phuong Chi Thi Nguyen
(74) *Attorney, Agent, or Firm* — Von Rohrscheidt Patents

(57) ABSTRACT

A terminal clamp including a contact cage including a cage ceiling, two cage side walls respectively adjoining the cage ceiling at a respective side and a cage floor, wherein the cage ceiling, the cage floor and the cage side walls form a portion of a cage jacket; a spring element which forms a clamping device together with a reaction bearing formed by the cage ceiling, the clamping device configured to support and electrically contact an electrical conductor; a conductor insertion opening arranged at a face of the contact cage upstream of the clamping device in a conductor insertion direction x; a cage jacket cutout in the cage jacket configured to provide access to the spring element for an opening tool configured to adjust a position of the spring element relative to the reaction bearing and to open the clamping device.

10 Claims, 8 Drawing Sheets

TERMINAL CLAMP WITHOUT HOUSING

RELATED APPLICATIONS

This application claims priority from German patent application DE 10 2019 125 886.3, filed on Sep. 26, 2019, which is incorporated in its entirety by this reference.

FIELD OF THE INVENTION

The invention relates to a terminal clamp.

BACKGROUND OF THE INVENTION

Terminal clamps of a generic type are typically configured without a housing as surface mount devices (SMD). The terminal clamps are placed onto circuit boards and are used for connecting connection conductors, in particular single wire or multi-wire cables. Multi-wire cables have a conductor that includes plural individual wires. Generic terminal clamps are typically highly miniaturized and are typically arranged in rows adjacent to one another, wherein terminal clamps without housing have to a minimum insulation distance from one another. This minimum insulation distance however is typically smaller than a distance of two housing walls that are arranged adjacent to one another of terminal clamps that include a housing.

DE 10 2015 122 400 A1 discloses a generic terminal clamp. The terminal clamp includes a cutout in a side wall of the terminal clamp. An actuation device is run out through the cut out wherein the actuation device is operatively connected with the spring element that is inserted into the terminal clamp in order to clamp and fix the connection cable. This actuation device is configured to offset the spring element from its reaction bearing in order to be able to insert the connection cable into the terminal clamp without friction and vice versa to remove connection cables that are supported in the terminal clamp from the terminal clamp.

The printed document recited supra also discloses a tool for opening the clamping device. This opening tool includes a tunnel shaped cut out which is used to receive the terminal clamp in the opening tool. One of the sections of the opening tool that is parallel to side walls of the terminal clamp cooperates with the actuation device of the terminal clamp. Placing the opening tool onto the terminal clamp and depressing the spring element opens the clamping device.

These known devices certainly leave room for improvement. The actuation device configured as a metal electrically conductive component as well as the opening tool have a negative effect on a minimum distance required between two terminal clamps arranged adjacent to one another and thus limit installation space minimization when plural terminal clamps are arranged adjacent to one another.

BRIEF SUMMARY OF THE INVENTION

Thus, it is an object of the invention to provide a terminal clamp of this general type, in particular without housing wherein an opening mechanism of the clamping device has an advantageous effect on arrangement distances that have to be maintained.

The object is achieved by a terminal clamp, including a contact cage including a cage ceiling, two cage side walls respectively adjoining the cage ceiling at a respective side and a cage floor, wherein the cage ceiling, the cage floor and the two cage side walls form a portion of a cage jacket; a spring element which forms a clamping device together with a reaction bearing formed by the cage ceiling, the clamping device configured to support and electrically contact an electrical conductor; a conductor insertion opening arranged at a face of the contact cage upstream of the clamping device in a conductor insertion direction; a cage jacket cutout in the cage jacket configured to provide access to the spring element for an opening tool configured to adjust a position of the spring element relative to the reaction bearing and to open the clamping device, wherein the cage jacket cut out is formed by an opening in the cage ceiling through which the opening tool is insertable for a direct or indirect access to the spring element.

It is an essential advantage of the invention that access required for reaching the spring element and thus for opening the clamping device is arranged in the cage ceiling. Thus, it is no longer required to run an actuation device for the spring element through the cage side wall wherein the actuation device being an electrically conductive component is essential for determining an insulation distance from an adjacent component, in particular to an adjacent terminal clamp of the same type.

Advantageously an embodiment is provided where the opening of the cage ceiling transitions into a cut out of a side wall that is adjacent to the opening.

When the opening in the cage ceiling transitions into a cut out of the adjacent side wall it is possible to impact the spring element with a lateral offset from the cage center axis. Thus, an opening tool is applied laterally from the connection cable retained in the terminal clamp or laterally from the conductor receiving cavity that is provided for a connection cable to be inserted wherein the opening tool impacts the spring element. Thus, a collision or an operating conflict between the opening tool for depressing the spring element in a direction towards the cage floor and a connection cable is avoided.

An advantageous embodiment includes two jacket recesses that are configured as mirror images with respect to a longitudinal cage plane that is parallel to the side wall.

It is an essential advantage of this embodiment that an opening tool with two tool contact surfaces that are offset from one another can impact the spring element. This has an advantage over a one sided impact since a tilting of the spring element is avoided. This tilting can wedge the spring element in the terminal clamp and can prevent the spring element from pivoting back into a contact position at the reaction bearing that clamps the conductor.

Therefore the it is advantageous that the jacket cut outs are offset from a cage ceiling bar that is arranged between the jacket cut outs.

When the material bar is configured accordingly it aides in correctly positioning the opening tool.

It is advantageously provided that the cage jacket forms a support contour for the spring element and that the support contour of the jacket transitions into the jacket recess.

This embodiment has significant fabrication advantages because the support contour can be fabricated together with the jacket recess in one fabrication step using a corresponding stamping tool. It is particularly advantageous to configure the support contour, the opening in the cage ceiling and the cut out in the side wall as a uniform jacket cut out.

The object is furthermore achieved by an opening tool for the terminal clamp recited supra, wherein the opening tool is configured to access and displace the spring element that forms the clamping device in combination with the reaction bearing, and wherein the opening tool includes at least one tool boss that is shaped cylindrical.

Advantageously an opening tool is used that has a movement end stop that limits a penetration depth of the tool boss into the jacket cut out in order to prevent a damaging movement of the spring element of the terminal clamp.

The movement end stop prevents and excessive loading of the spring element and thus reliably prevents an excessive movement of the spring element and thus damages to the spring element.

Advantageously the movement end stop cooperates with a cage ceiling of a contact cage of the terminal clamp.

Furthermore two tool bosses are provided that receive the movement of end stop between each other wherein the tool bosses are configured in particular identical.

In an advantageous embodiment the tool boss has a circular cylindrical section that constricts a conductor receiving cavity when placed into the jacket cut out of the terminal clamp and guides a conductor that is to be inserted into the conductor receiving cavity.

This provides the advantage of centering the conductor in the clamping device and assuring that the spring element is not tilted by an off center conductor and assuring that individual wires of a multi-wire conductor do not exit from the jacket opening provided for the tool boss.

BRIEF DESCRIPTION OF THE DRAWINGS

An improved comprehension of the invention and further advantages of the invention can be derived from the subsequent description of an embodiment with reference to drawing figures, wherein.

DETAILED DESCRIPTION OF THE INVENTION

Figure 1:
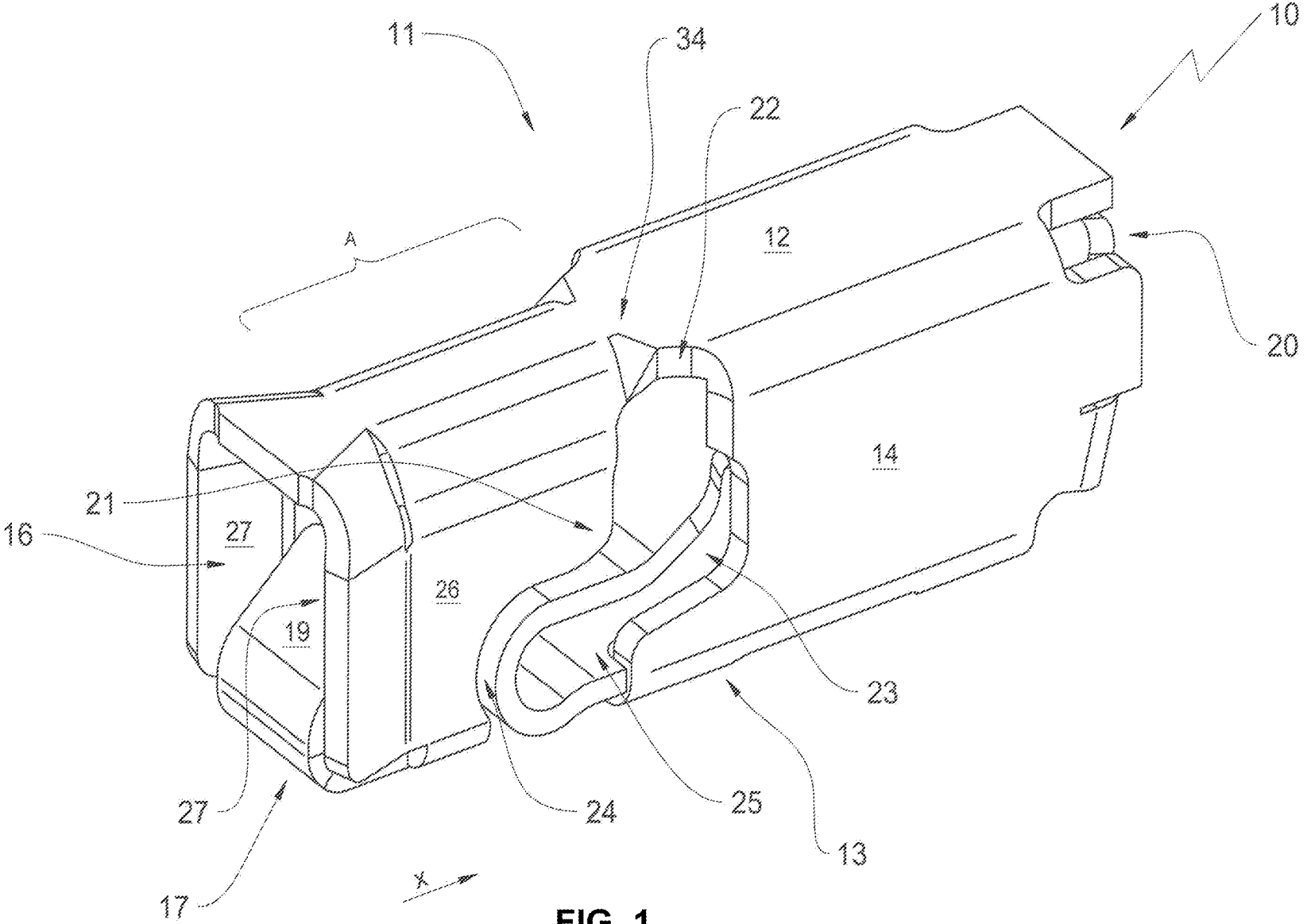
FIG. 1 illustrates a terminal clamp according to the invention in a perspective view.

In the drawing figures the terminal clamp according to the invention is designated overall with the reference numeral 10. The terminal clamp 10 is illustrated in FIG. 1 in a perspective view. The terminal clamp includes a contact cage 11 that is formed by a cage ceiling 12, a cage floor 13 and two side walls 14 that connect the cage floor 13 and the cage ceiling 12.

Figure 3:
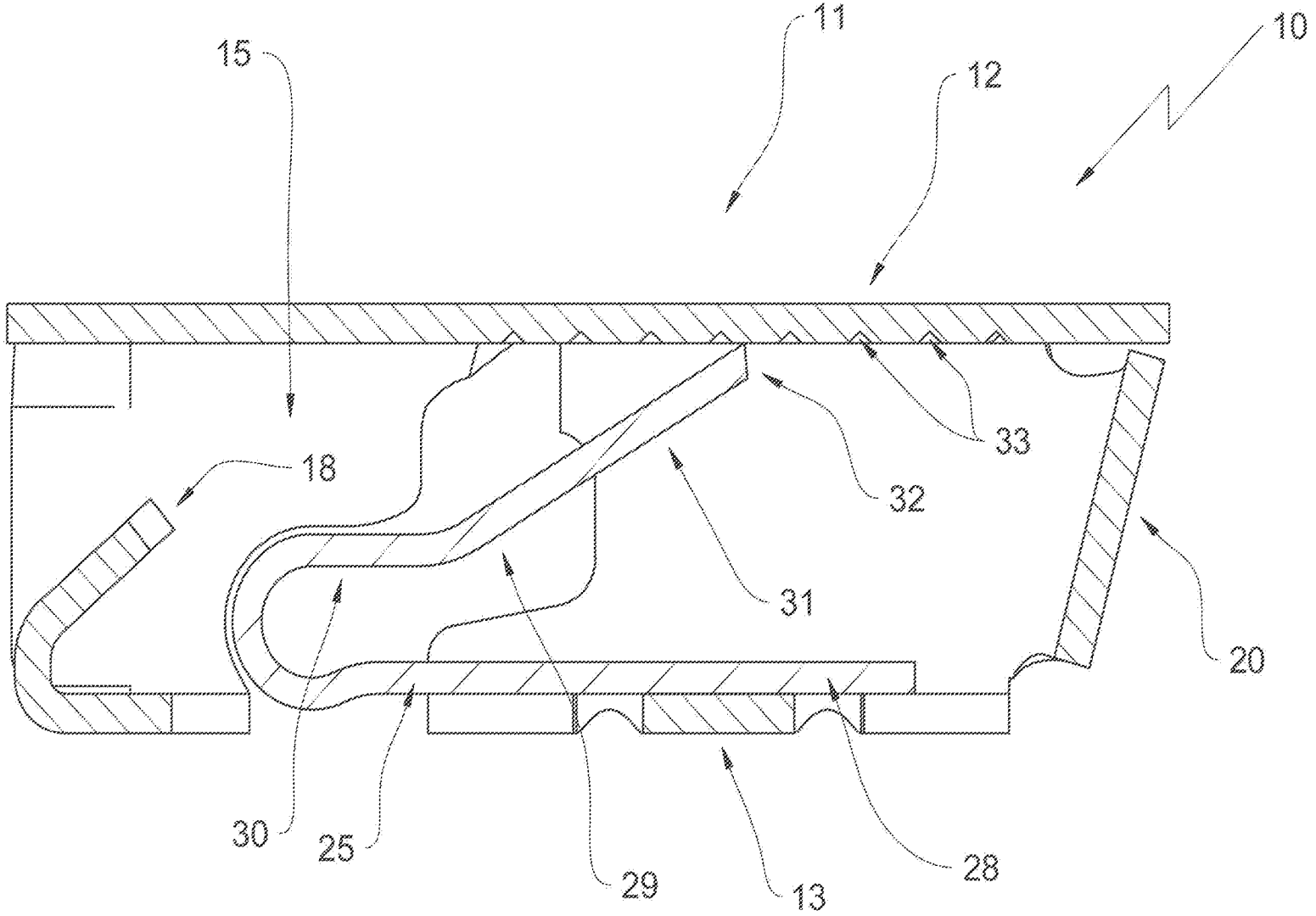
FIG. 3 illustrates a terminal clamp according to FIG. 1 in a sectional view along a vertical longitudinal sectional plane.

The cage ceiling 12, the cage floor 13 and the side walls 14 jointly form the cage jacket and envelop a conductor receiving cavity 15 (c.f. FIG. 3). The contact cage 11 includes a conductor insertion opening 16 at a first face where a connection conductor, e.g. a single wire or multi-wire cable is inserted in the conductor insertion direction x in order to provide electrical contacting. The cage floor 13 forms a guide tongue 17 in a portion of the conductor insertion opening 16 wherein the guide tongue extends from the conductor insertion opening 16 in a direction towards an opposite second face of the cage and wherein a free end 18 of the guide tongue (c.f. FIG. 3) is oriented in a direction towards the cage ceiling 12. This way the guide tongue 17 forms a first slanted support surface 19.

The second face of the contact cage 11 that is arranged opposite to the conductor insertion opening 16 is closed by a stabilization wall 20 (c.f. FIG. 3).

The contact cage 11 includes two jacket cut outs 21 that are arranged mirror symmetrical to a vertical longitudinal center plane that is not illustrated. The respective jacket cutouts 21 can be divided into an opening 22 of the cage ceiling 12, a cut out 23 of the side wall 14 and a support contour 24 that is partially fabricated into the side wall 14 and partially fabricated into the cage floor 13. The support contour 24 facilitates fixing a spring element 25 in the contact cage 11.

The cage jacket is constricted in a portion A between the conductor insertion opening 16 and the cage ceiling opening 22. This yields a cross section reduction of the perpendicular contour of the terminal clamp 10 wherein the cross reduction tapers along the contact cage longitudinal axis that is formed in particular by side wall sections 26 that are offset towards the vertical longitudinal center plane. Due to the inward offset side wall sections 26 the side walls 14 form second slanted support surfaces 27 in a portion of the conductor insertion opening 16 so that a funnel shaped conductor insertion portion is formed that is arranged upstream of the contracted jacket portion A in the conductor insertion direction x.

Figure 2:
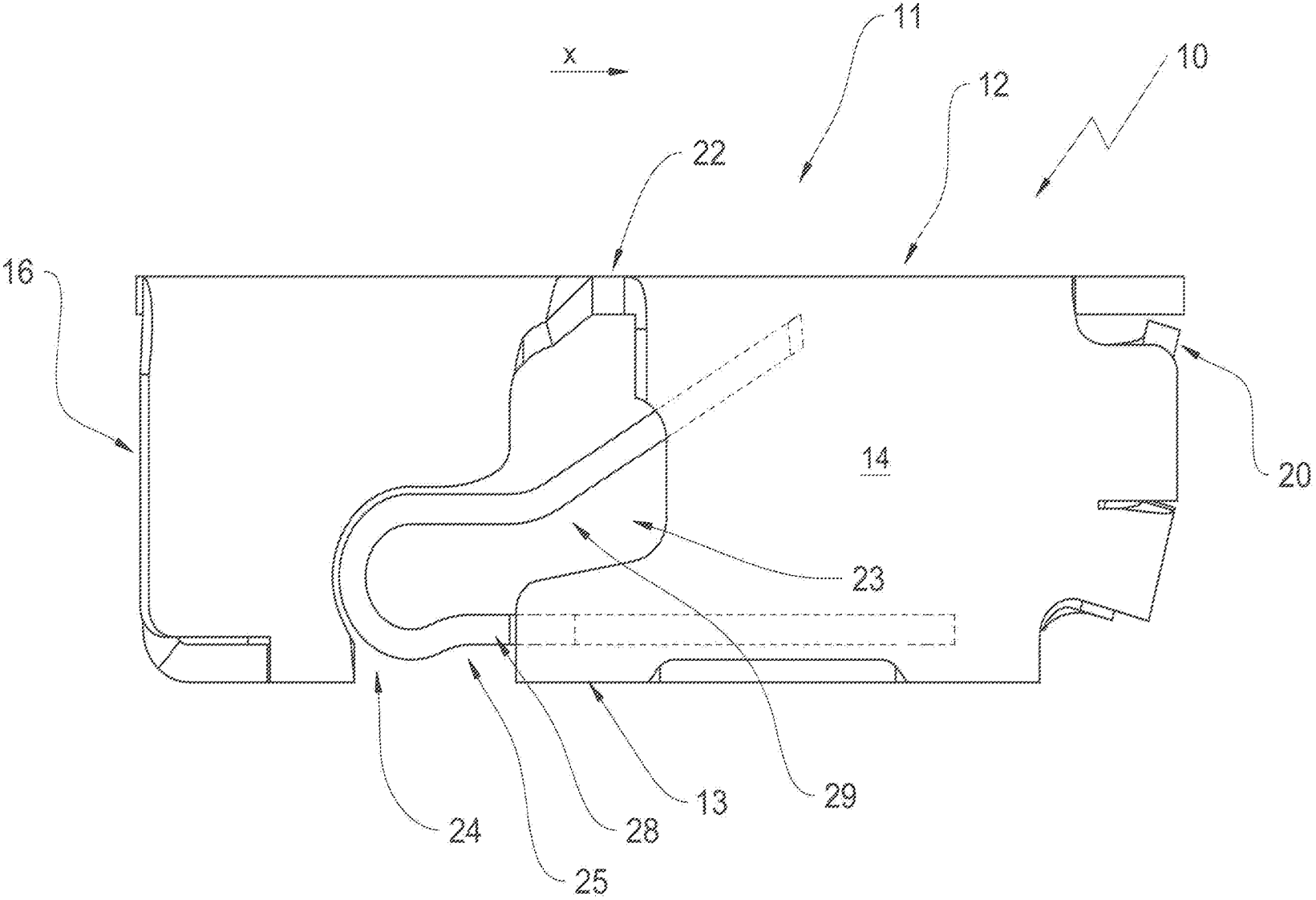
FIG. 2 illustrates the terminal clamp according to FIG. 1 in a side view.

FIG. 2 illustrates the terminal clamp 10 according to FIG. 1 in a side view.

FIG. 3 illustrates a sectional view of the terminal clamp 10 according to FIG. 2 in a vertical longitudinal sectional plane. The spring element 25 is clearly visible and partially drawn in dashed lines in FIG. 2. The spring element is an arm spring that includes a first arm 28 that is parallel to the cage floor and a second arm 29. Both arms 28, 29 are connected with each other by a U shaped section.

The second arm 29 is divided into a contact section 30 that is parallel to the cage floor and a clamping section 31 that is deflected towards the cage ceiling 12 and preloaded. The clamping section 31 cooperates with the cage ceiling 12 that functions as a reaction bearing and forms a clamping device 32. The clamping device 32 supports the insulation stripped end of a connection cable in order to provide electrical contacting and mechanical fixation. Thus, the inner surface of the cage ceiling 12 includes a profile in the form provided in a form of notches 33. The notches increase a friction between the contact cable and the cage ceiling 12 and thus provide additional pull out safety.

Figure 4:
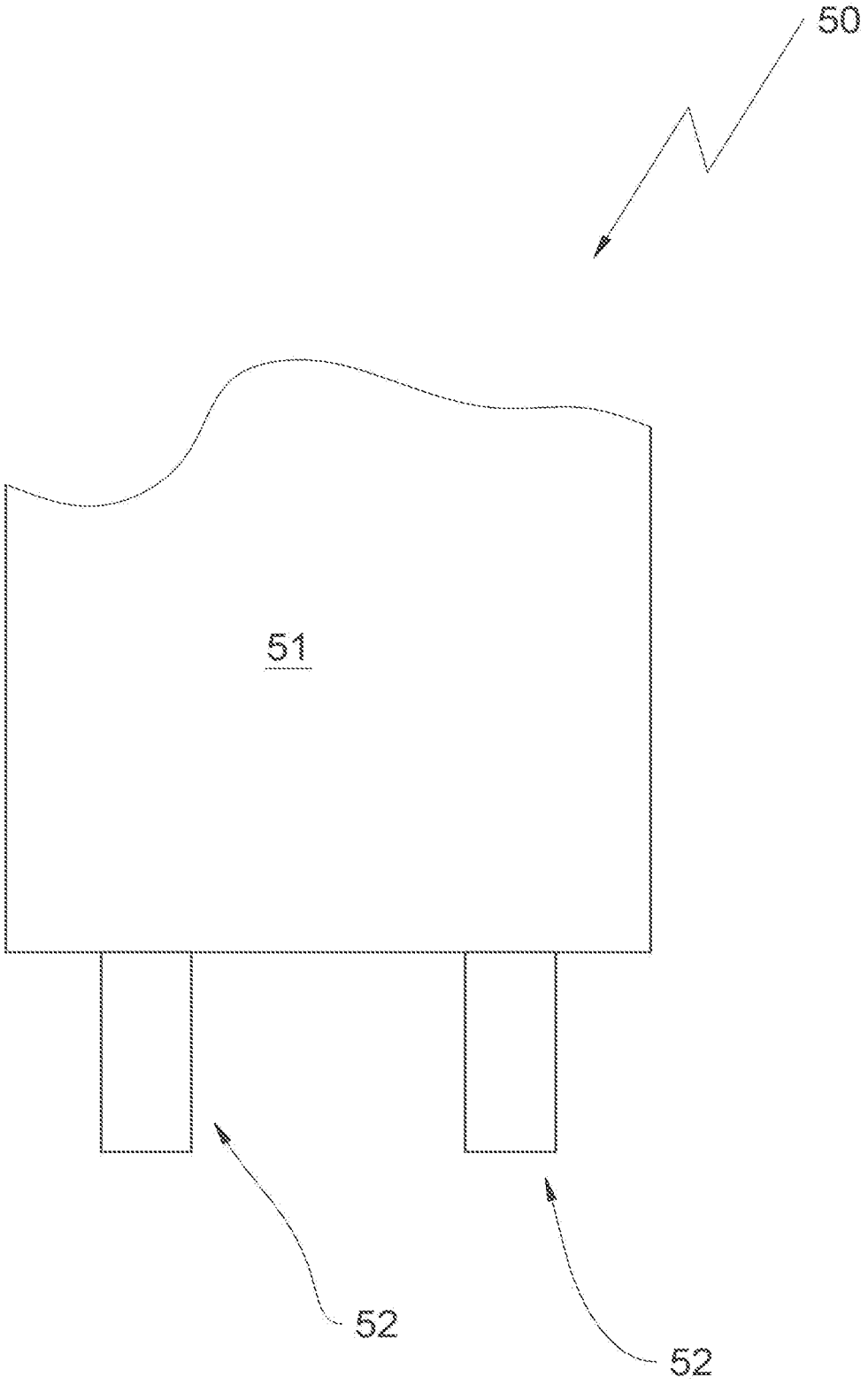
FIG. 4 illustrates an opening tool according to the invention.
Figure 5:
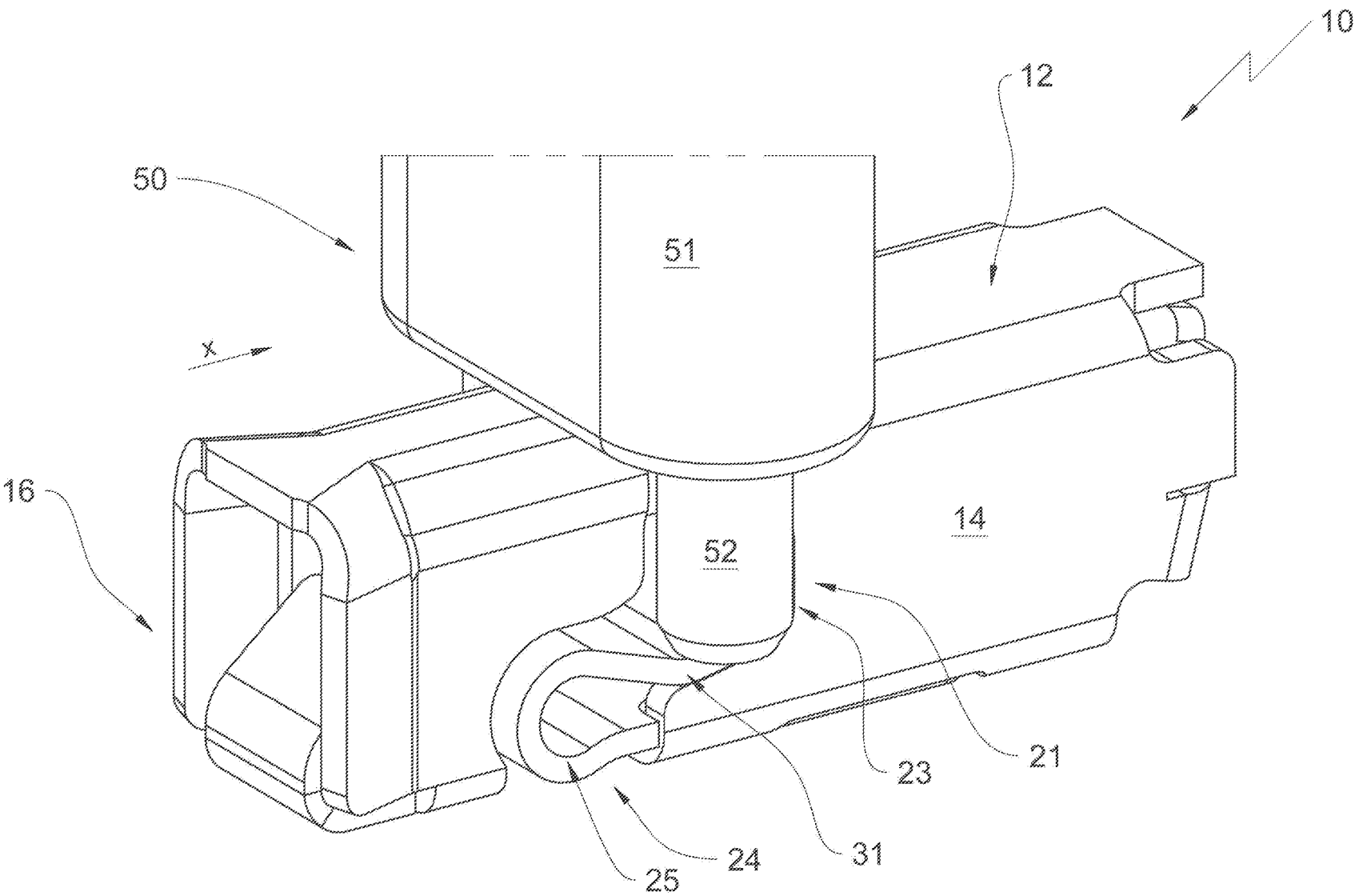
FIG. 5 illustrates the opening tool according to FIG. 4 in an operating position at a terminal clamp according to FIG. 1.
Figure 6:
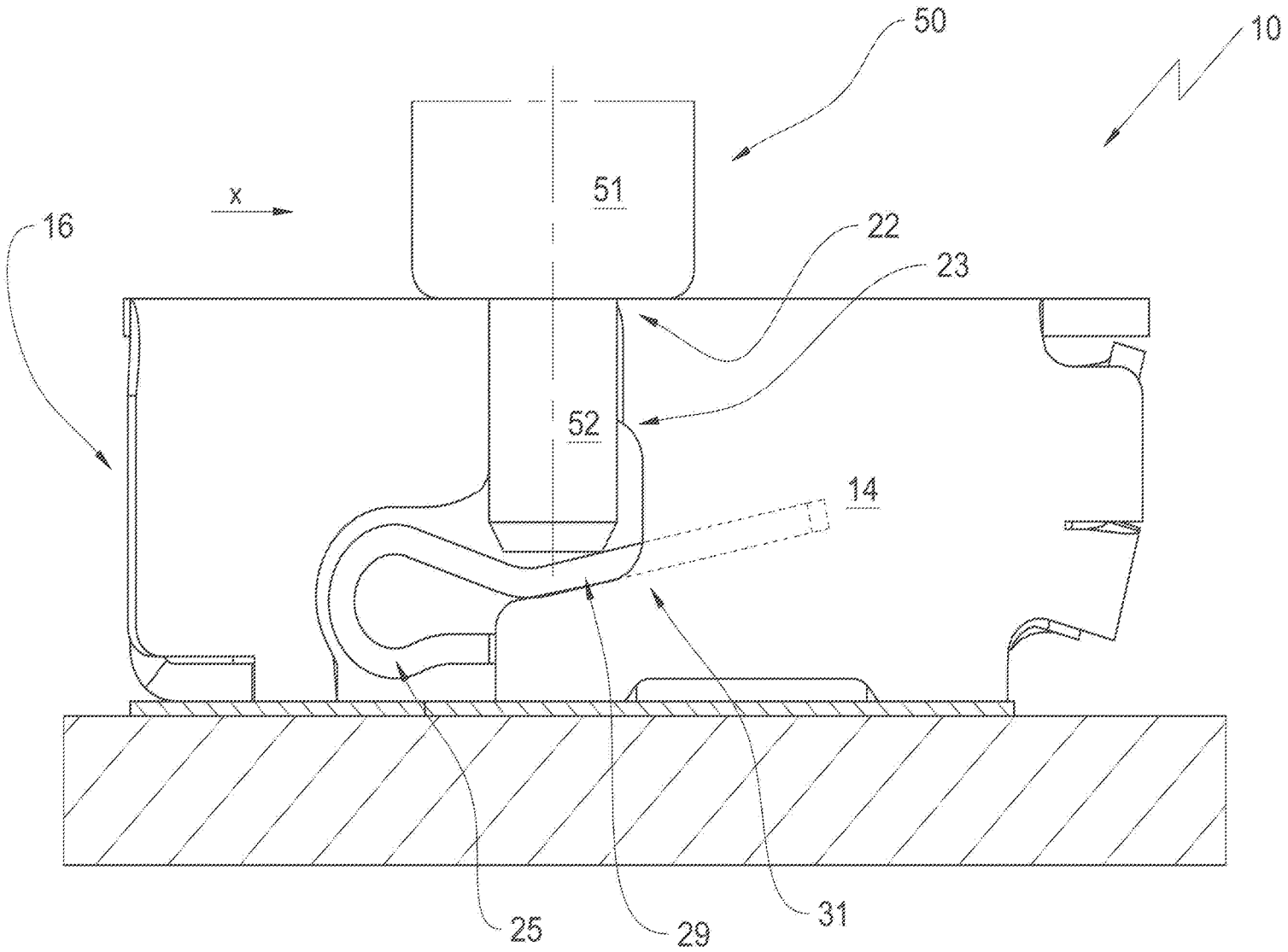
FIG. 6 illustrates the representation according to FIG. 5 in a side view.

FIG. 4 illustrates a schematic representation of an opening tool 50 with a tool head 51 that has two tool bosses 52. The tool bosses are offset from each other and substantially configured cylindrical and identical. The tool bosses are adapted with respect to their cross section contour to the openings 22 of the cage ceiling 12 wherein the tool bosses are configured to penetrate into the openings 22 of the cage ceiling 12. A distance of the tool bosses 52 from each other is selected so that the tool bosses can receive the cage ceiling bar 34 between each other that remains between the cage ceiling openings 22 (c.f. e.g. FIG. 1). FIGS. 5 and 6 illustrate how the opening tool 50 cooperates with the terminal clamp 10 to open the clamping device 32.

In order to open the clamping device 32 of the terminal clamp 10 the cylindrical tool bosses 52 are positioned above the openings 22 of the cage ceiling 12 and inserted into the openings 22 thereafter. The opening tool 50 is moved in a direction towards the cage floor 13 wherein the tool bosses 52 penetrate the cut outs 23 of the side walls 14 after passing through the openings 22 of the cage ceiling 13. Eventually the tool bosses impact the spring element 25 with faces that are oriented towards the cage floor 13, wherein the tool bosses impact the second spring arm 29 that is oriented towards the cage ceiling, in particular in its clamping section 31. Further displacement of the opening tool 50 in a direction towards the cage floor 13 causes a movement of the clamping section 31 in a direction towards the cage floor 13. Thus, the free end of the clamping section 31 is separated form inner surface of the cage ceiling 12 and thus opens the clamping device 32. This opening movement is terminated when the tool head 51 contacts the outer surface of the cage ceiling 12. Thus the face of the tool head 51 that is oriented towards the terminal clamp 10 or its portion that is arranged between the tool bosses 52 forms a movement stop.

The maximum deflection situation of the clamping section 31 or the maximum opening of the clamping device 32 is illustrated in FIGS. 5 and 6. It is clearly evident how the surface section of the opening tool 50 that is oriented towards the cage floor 13 or downward forming a movement stop contacts the cage ceiling 12. In the side view of the terminal clamp 10 according to FIG. 6 a portion of the clamping section 31 of the spring element 25 that is arranged behind the side wall is drawn in dashed lines. It is clearly visible that the clamping section is offset from the cage ceiling 12 so that the clamping device 32 is open. In this deflected position, the second spring arm 29 the insulation stripped end of a terminal cable is insertable into the open clamping device 32 without additional resistance or a connection cable placed therein is removable in a simple manner.

The tool bosses 52 that penetrate the conductor receiving cavity 15 with part of their circumference support an insertable conductor due to their circular cylindrical circumferential surface. The conductor slides on the enveloping surfaces of the tool bosses 52 and is moved in a direction towards a center in case the conductor is offset from the vertical longitudinal center plane. This is particularly advantageous for multi-wire cable connections. In these multi-wire cables the electrically conductive wire has plural individual strands. In case these strands are not tinned and slightly mushroom shaped or spliced due to mechanical interference the outer surfaces of the tool bosses 52 guide the individual strands towards the center or vertical longitudinal center plane of the contact cage 11 and thus away from the lateral cut outs 23. Thus, an exit of the individual strands of a connection cable from the contact cage 11 is reliably prevented.

When the tool bosses 52 are sized with respect to their diameter so that they substantially close the cut outs 23 of the side walls 14 an escapement of the conductor to be inserted into the terminal clamp 10 during manual or robotic insertion is additionally prevented.

Figure 7:
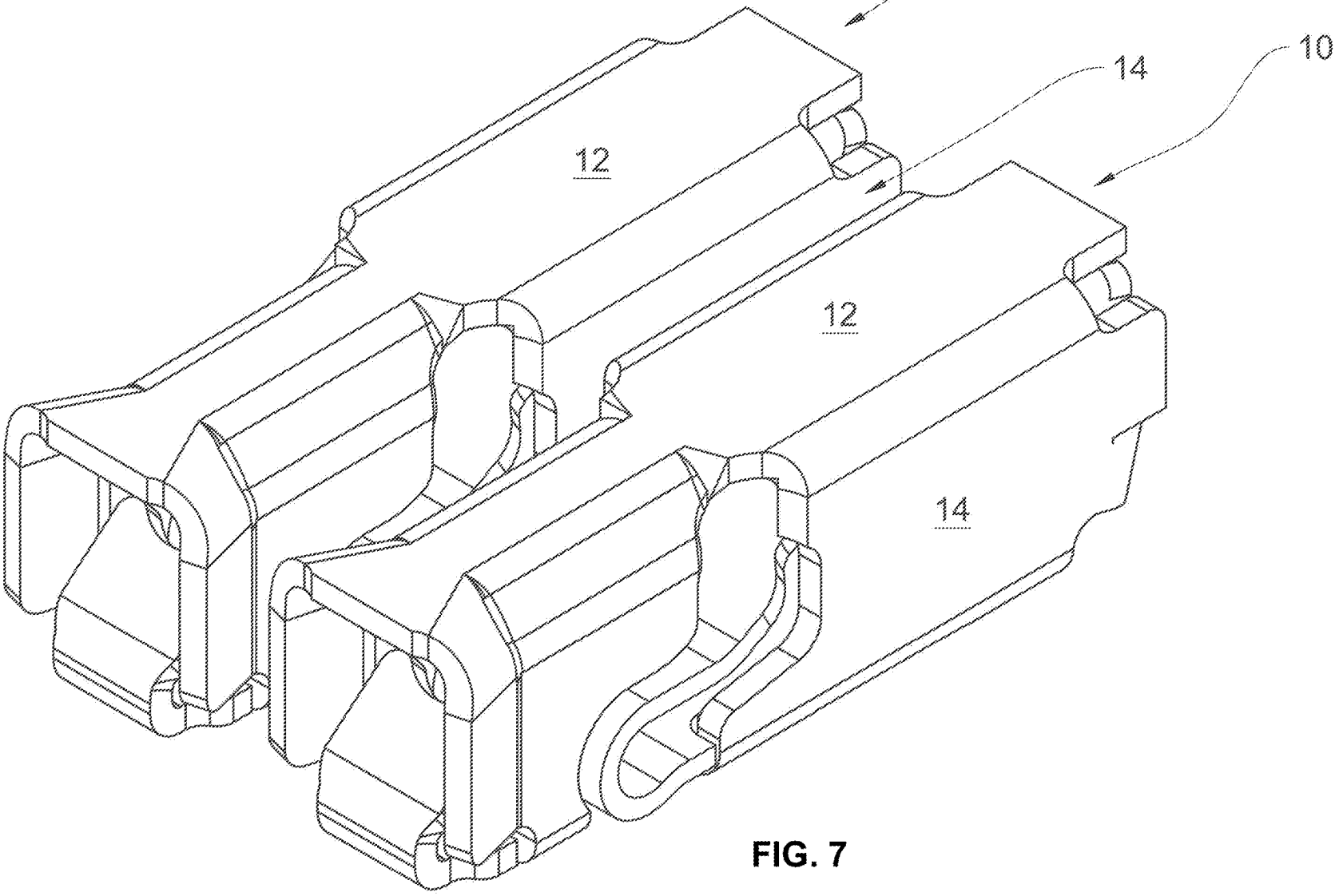
FIG. 7 illustrates the arrangement of two terminal clamps according to FIG. 1 adjacent to each other.
Figure 8:
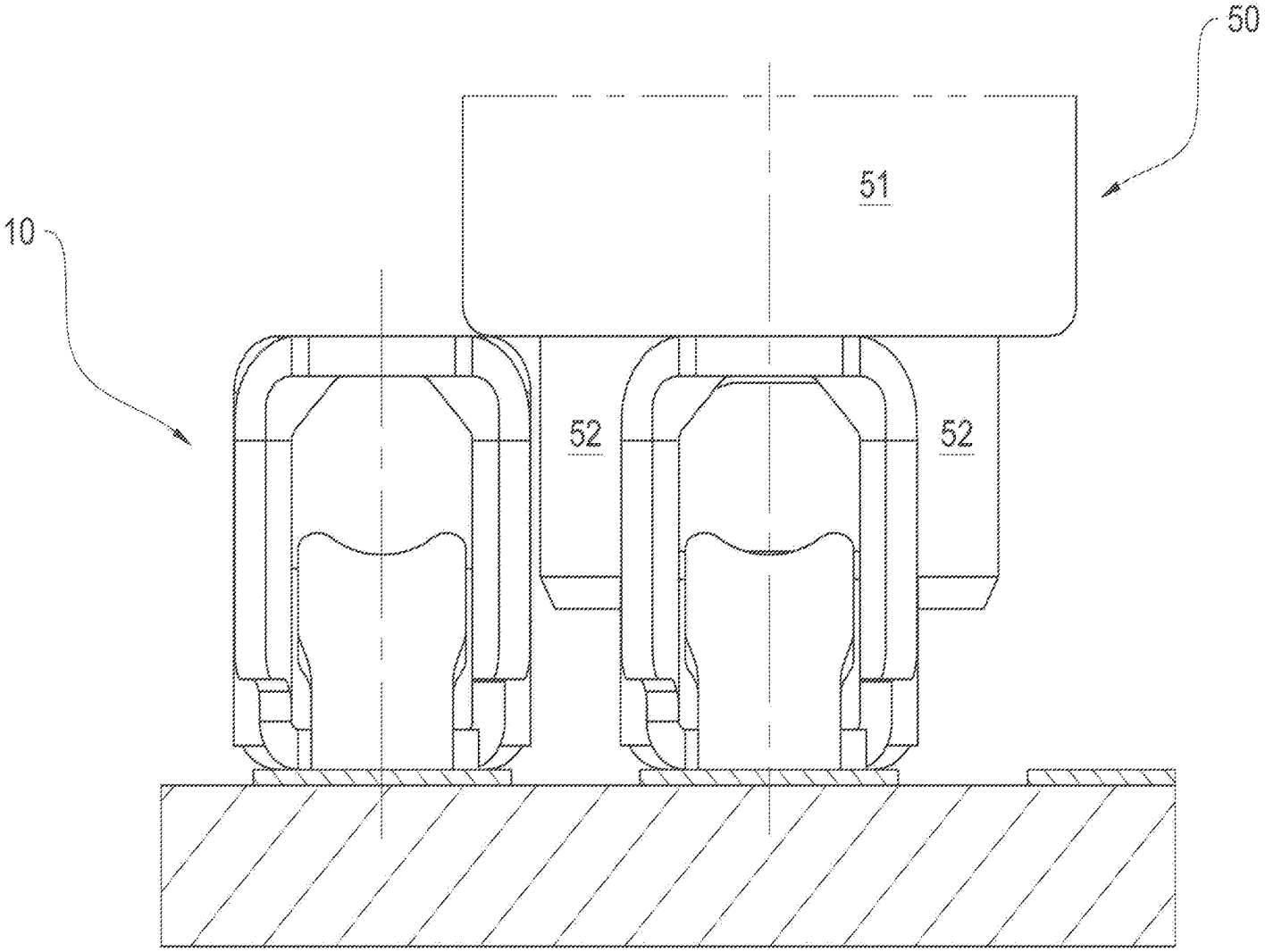
FIG. 8 illustrates a representation according to FIG. 7 with the opening tool according to FIG. 4 in an operating position.

Another essential advantage of the invention is described with reference to FIGS. 7 and 8. FIG. 7 illustrates two terminal clamps 10 that are arranged in pairs adjacent to each other in a perspective view. FIG. 8 illustrates a view of the conductor insertion openings 16 of two terminal clamps 10 that are arranged in pairs adjacent to each other. FIG. 8 is furthermore supplemented with a representation of an opening tool 50.

FIGS. 7 and 8 illustrate two terminal clamps 10 in an exemplary manner in a typical arrangement. The distance of both terminal clamps 10 from each other is limited to a minimum that is caused by the insulation distance. Since the cylindrical perpendicular contour determines the width of the contact cage 11 in the terminal clamps 10 according to the invention and no lateral actuation devices protrudes which differs from the prior art, only the cage width determines the minimum distance of terminal clamps 10 from each other.

FIG. 8 illustrates that increasing the minimum distance is not required also with respect to the opening tool 50 that is to be used. Since the tool bosses 52 penetrate the interior of the contact cage 11 with a partial circumferential section the insulation distance is sufficient to be able to use the opening tool 50 according to the invention to open the clamping device 32.

The terminal clamp 10 according to the invention facilitates minimizing the installation space on a circuit board that is required for insulation purposes which is particularly advantageous when arranging plural terminal clamps 10 adjacent to each other. Furthermore the terminal clamp 10 according to the invention facilitates opening the clamping device 32 for inserting or retrieving connection conductors using the opening tool 50 according to the invention.

REFERENCE NUMERALS AND DESIGNATIONS

10 terminal clamp
11 contact cage
12 cag ceiling
13 cage floor
14 side wall
15 conductor receiving cavity
16 conductor insertion opening
17 guide tongue
18 free end of 17
19 first slanted support surface
20 stabilization wall
21 jacket cut out
22 opening of 12
23 cut out
24 support contour
25 spring element
26 side wall section
27 second slanted support surface
28 first arm
29 second arm
30 contact section of 29
31 clamping section
32 clamping device
33 notch
34 cage ceiling bar
50 opening tool
51 tool head
52 tool boss
A contracted portion
x conductor insertion direction

What is claimed is:

1. A terminal clamp, comprising:

a contact cage including a cage ceiling, two cage side walls respectively adjoining the cage ceiling at a respective side and a cage floor, wherein the cage ceiling, the cage floor and the two cage side walls form a portion of a cage jacket;

a spring element which forms a clamping device together with a reaction bearing formed by the cage ceiling, the clamping device configured to support and electrically contact an electrical conductor;

a conductor insertion opening arranged at a face of the contact cage upstream of the clamping device in a conductor insertion direction;

a cage jacket cutout in the cage jacket configured to provide access to the spring element for an opening tool configured to adjust a position of the spring element relative to the reaction bearing and to open the clamping device, wherein the cage jacket cut out is formed by an opening in the cage ceiling through which the opening tool is insertable for a direct or indirect access to the spring element.

2. The terminal clamp according to claim 1, wherein the opening in the cage ceiling transitions into a cut out of a cage side wall that is adjacent to the opening in the cage ceiling.

3. The terminal clamp according to claim 1, wherein the cage jacket forms a support contour for the spring element, and wherein the support contour of the cage jacket transitions into the cage jacket cut out.

4. The terminal clamp according to claim 1, wherein two cage jacket cut outs are provided that are configured in a mirror symmetrical arrangement with respect to a longitudinal cage plane that is parallel to the two cage side walls.

5. The terminal clamp according to claim 4, wherein the two cage jacket cut outs are offset from a cage ceiling bar that is arranged between the two cage jacket cut outs.

6. The terminal clamp according to claim 1, wherein the opening tool is configured to access and displace the spring element that forms the clamping device in combination with the reaction bearing, and wherein the opening tool includes at least one tool boss that is shaped cylindrical.

7. The terminal clamp according to claim 6, wherein the at least one tool boss includes two tool bosses that receive the movement stop between each other, and wherein the two tool bosses are configured identical.

8. The terminal clamp according to claim 6, wherein the at least one tool boss includes a circular cylindrical section that constricts the conductor receiving cavity and guides a conductor that is inserted into the conductor receiving cavity when the circular cylindrical section is inserted into the jacket cut of the terminal clamp.

9. The terminal clamp according to claim 6, further comprising:

a movement stop that limits a penetration depth of the tool boss in the jacket cut out configured and is configured to prevent a movement of the spring element of the terminal clamp that causes damage to the spring element or the terminal clamp.

10. The terminal clamp according to claim 9, wherein the movement stop cooperates with the cage ceiling of the contact cage of the terminal clamp.

* * * * *